US005903869A

United States Patent [19]

Jacobson et al.

[11] Patent Number: 5,903,869

[45] **Date of Patent: *May 11, 1999**

[54] STICK-ON MICROCHIP RECORDING AND REPRODUCING APPARATUS TEMPORARILY FASTENABLE IN SELECTABLE LOCATIONS FOR MESSAGE CONVEYANCE-, AUDIO MAIL-, PRODUCT PROMOTION-, OR SELF-REMINDER PURPOSES

[75] Inventors: Eric C. Jacobson, Los Angeles; Bernard A. Hallman, San Jose, both of Calif.

[73] Assignee: Eric C. Jacobson, Los Angeles, Calif.

[ * ] Notice: This patent issued on a continued prosecution application filed under 37 CFR 1.53(d), and is subject to the twenty year patent term provisions of 35 U.S.C. 154(a)(2).

[21] Appl. No.: 08/328,819

[22] Filed: Oct. 24, 1994

[51] Int. Cl.[6] ..... G10L 3/00; G09B 5/04; A47G 1/17; A63H 3/33

[52] U.S. Cl. ..... 704/272; 434/319; 248/205.3; 369/31; 369/63

[58] Field of Search ..... 395/2.79, 2.81; 248/205.3; 428/41.7, 41.9, 42.3, 354; 369/25, 31, 63, 64, 65, 66, 67, 68, 14, 84; 434/319; 704/270, 272; D14/154

[56] References Cited

U.S. PATENT DOCUMENTS

| | | | |
|---|---|---|---|
| D. 299,336 | 1/1989 | Osanai et al. | D14/225 |
| D. 332,787 | 1/1993 | Davis | D14/160 |
| 2,517,181 | 8/1950 | Davis . | |
| 3,312,475 | 4/1967 | Mazuranic . | |
| 3,767,206 | 10/1973 | Rehklau et al. | 369/84 |

(List continued on next page.)

FOREIGN PATENT DOCUMENTS

| | | | |
|---|---|---|---|
| 2052395 | 4/1972 | Germany . | |
| 4207447 | 9/1993 | Germany | 395/2 |

OTHER PUBLICATIONS

Disclosure Document 189818, Mar. 31, 1988; Jacobson, Eric C. (Corresponding with U.S. Patent 5,166,851 to Jacobson, Eric C.).

(List continued on next page.)

*Primary Examiner*—Daniel S. Hunter

[57] ABSTRACT

A stick-on audio microchip recorder/playback product for message conveyance-, audio mail-, product promotion and self-reminder purposes. The product enables a user to record a personal (or business-oriented) message or self-reminder, and non-permanently fasten the recorder upon surfaces such as household doors, walls, mirrors; compatible (carry-able) objects such as appointment books or notebooks; or upon interiors of mailing-, packaging- or shipping vessels, in desired temporary locations where the intended recipient would be most likely to encounter it. The recorder is easily removable by the end-user, and reusable. A microchip recording/playback circuit, microphone, speaker, battery and record/playback controls, are secured in a housing. Preferably, the housing has on its underside an attached stick-on fastener, including a stack of "pressure sensitive" peel-off adhesive stickers, each having on their undersurface a medium adhesion substance. Users may non-permanently fasten the recorder in desired temporary locations, remove the recorder from same with reasonable ease, and reposition it, optionally with a fresh peel-off sticker, and/or a new recorded message. Alternate "stick-on" fastening systems include Velcro, magnets, suction cups, or a conjoinable plate and housing. When used in mailing-, packaging- or shipping vessel interiors, the recorder may be removably nested in a free-standing stick-on protective jacket or foldable "pop-up" holder. By computer, a user may simultaneously program the same recorded message into multiple, mailable recorder units.

71 Claims, 4 Drawing Sheets

U.S. PATENT DOCUMENTS

| | | | |
|---|---|---|---|
| 3,999,446 | 12/1976 | Louzil et al. | 74/257 |
| 4,100,581 | 7/1978 | Slack et al. | 360/12 |
| 4,102,067 | 7/1978 | Tarrant | 40/455 |
| 4,222,188 | 9/1980 | Tarrant et al. | 40/152.1 |
| 4,500,019 | 2/1985 | Curley, Jr. | 224/222 |
| 4,541,805 | 9/1985 | Weaver et al. | 434/95 |
| 4,607,747 | 8/1986 | Steiner | 206/232 |
| 4,654,728 | 3/1987 | Lunsford | 360/74.1 |
| 4,670,798 | 6/1987 | Campbell et al. | 360/12 |
| 4,715,060 | 12/1987 | Lipscher et al. | 379/70 |
| 4,764,962 | 8/1988 | Ekman et al. | 381/24 |
| 4,791,741 | 12/1988 | Kondo | 40/124.1 |
| 4,828,105 | 5/1989 | Silengo et al. | 206/232 |
| 4,839,749 | 6/1989 | Franklin | 360/12 |
| 4,846,348 | 7/1989 | Smith | 206/387 |
| 4,974,759 | 12/1990 | McDonough | 224/39 |
| 4,981,243 | 1/1991 | Rogowski | 224/41 |
| 5,063,698 | 11/1991 | Johnson et al. | 40/124.1 |
| 5,070,755 | 12/1991 | Carroll | 84/600 |
| 5,114,185 | 5/1992 | Reedom | 280/801 |
| 5,166,851 | 11/1992 | Jacobson | 360/137 |
| 5,241,427 | 8/1993 | Lin | 360/1 |
| 5,245,171 | 9/1993 | Fox et al. | 235/492 |
| 5,293,999 | 3/1994 | Linngren | 206/525 |
| 5,294,229 | 3/1994 | Hartzell et al. | 434/336 |
| 5,387,108 | 2/1995 | Crowell | 434/319 |
| 5,500,987 | 3/1996 | Rosen | 24/351 |

OTHER PUBLICATIONS kitchenMINDER Audio Microchip Message Recorder Model #KM–1004, manufactured and sold by ALLIED VOICE TECH INC., Los Angeles, CA beginning in 1994. Product packaging states: “Made in China, Designed in USA”.

autoMINDER Audio Microchip Message Recorder manufactured and sold by ALLIED VOICE TECH INC., beginning in 1994. Product packaging unavailable but believed to state the same as above.

Fig. 1.
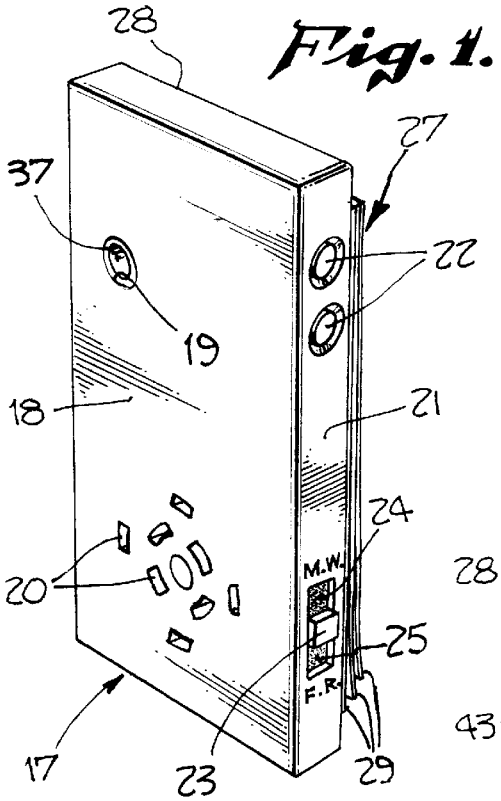
Fig. 3.
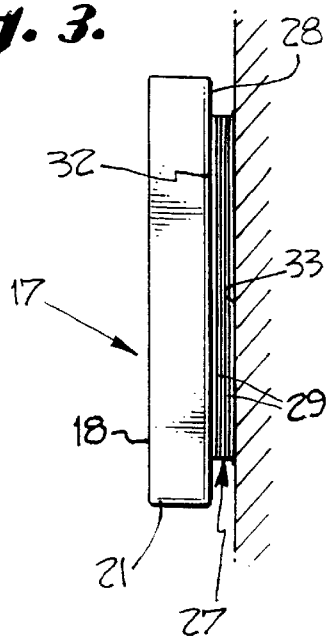
Fig. 5.
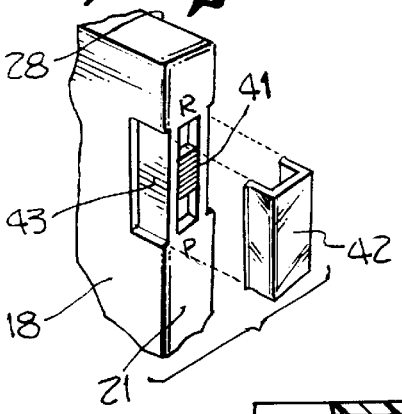
Fig. 2.
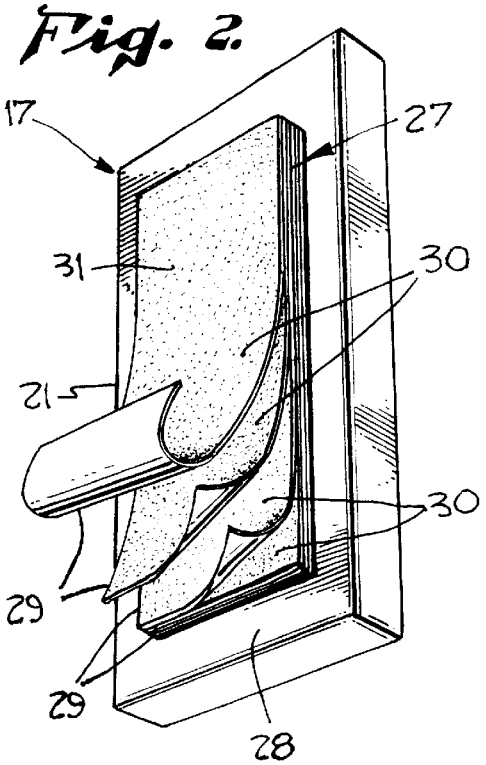
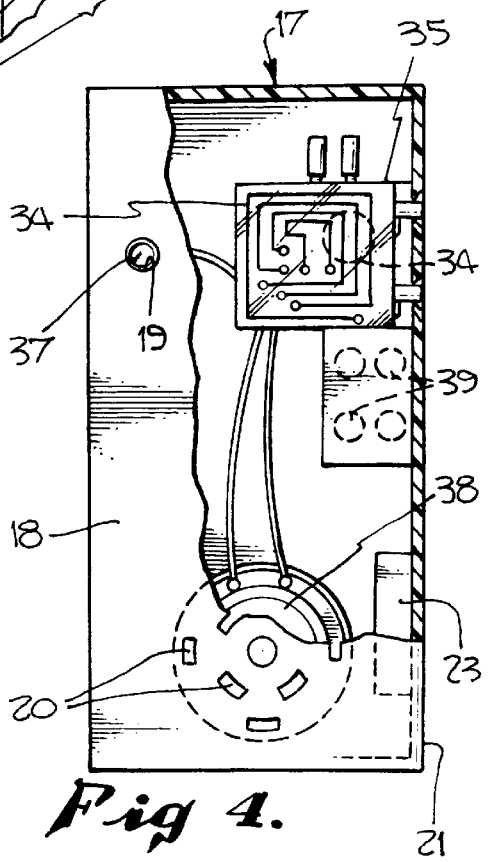
Fig 4.

Fig. 6.
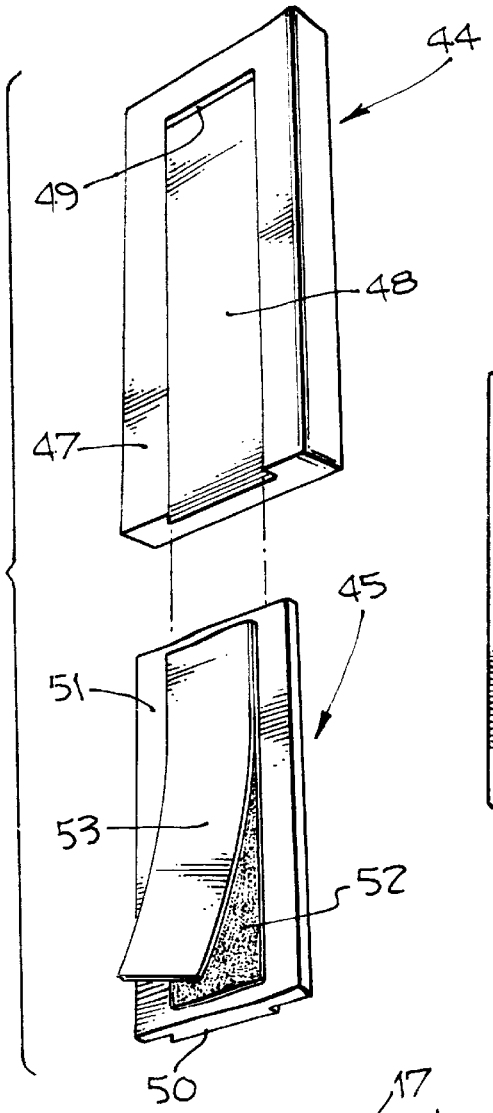
Fig. 7.
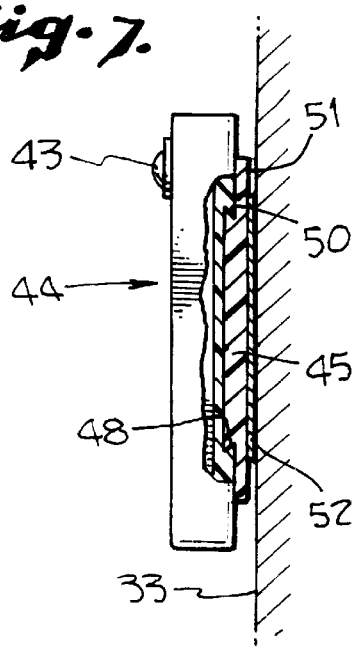
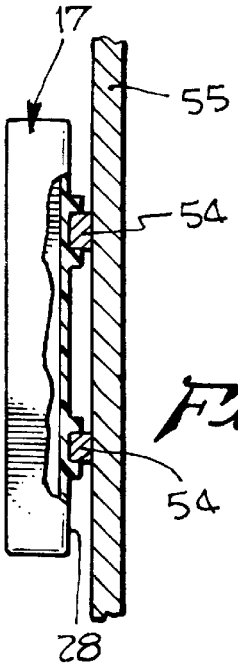
Fig. 8.
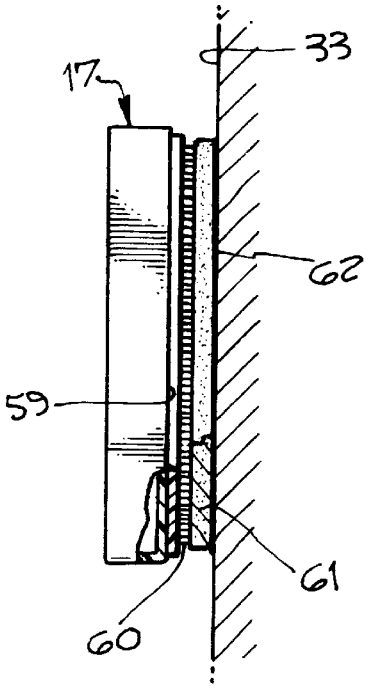
Fig. 10.
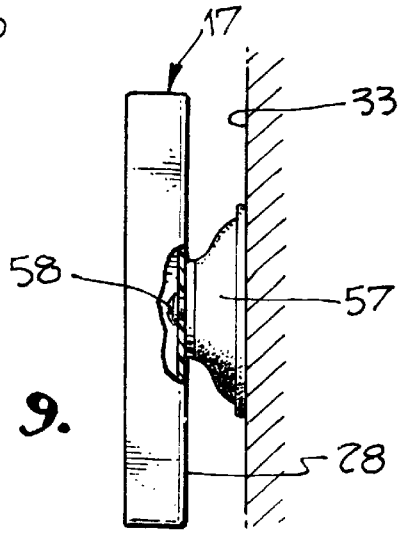
Fig. 9.

STICK-ON MICROCHIP RECORDING AND REPRODUCING APPARATUS TEMPORARILY FASTENABLE IN SELECTABLE LOCATIONS FOR MESSAGE CONVEYANCE-, AUDIO MAIL-, PRODUCT PROMOTION-, OR SELF-REMINDER PURPOSES

CROSS-REFERENCE TO RELATED APPLICATION

This application is related to application Ser. No. 502,845, filed Apr. 2, 1990, now U.S. Pat. No. 5,166,851, granted Nov. 24, 1992 to Eric C. Jacobson, a co-inventor of the present invention. Certain embodiments of said '851 invention were described in Disclosure Document 189818, dated Mar. 31, 1988, submitted to the U.S. Patent and Trademark Office by Eric C. Jacobson.

DISCLOSURE DOCUMENT

The invention disclosed in this application was described in certain embodiments in Disclosure Document 319598, dated Oct. 23, 1992, submitted to the U.S. Patent and Trademark Office by Eric C. Jacobson, a co-inventor of the present invention.

BACKGROUND OF THE INVENTION

This invention relates broadly to audio recording communication devices and practices, including message conveyance-, audio mail-, product promotion- and self-reminder systems, and specifically to a stick-on microchip recording and reproducing apparatus for fastening recorded voice messages or other audio information upon selectable surfaces or compatible objects in any desired temporary location.

The general advantages for many purposes of recorded audio communication over the written or printed medium are well known; they include the superior ease and speed of dictation (over handwriting or typing) and the opportunity to make a more personal and/or distinct impression on the receiver, by way of vocal inflection, tone of voice, etc. Accordingly, audio recording and reproducing devices and/or associated storage medium means, have been employed for multiple personal and business communication purposes, including for message conveyance-, audio mail-, audio product promotion- and self-reminder systems.

With respect to message conveyance, for example, it is not uncommon for members of households to leave one another recorded audio messages or "reminders" utilizing a specialized audiotape or recordable microchip feature of their telephone answering machines; these machines sometimes include a different colored blinking light for such intra-household messages than that signaling a waiting message received from an outside telephone line. Certain desktop personal computers also include a recordable microchip message or reminder feature which may be similarly employed by household members for this purpose.

With respect to audio mail, recorded audio messages are sometimes transited between separated parties by dictating an audiotape cassette and sending it through the mail or alternate postal-type carrier, optionally in a mailer or other packaging vessel customized to receive standard-sized cassettes, with or without an enclosure such as a written letter or photograph.

This form of audio mail communication may be practiced by widely separated loved ones (such as foreign-deployed military service personnel and their stateside families) who lack ready access to telephones, or between those who wish to economize on long-distance telephone charges or who otherwise prefer to "converse" via dictated tape.

This general practice is also facilitated and made more convenient by the self-contained "audio mailer" disclosed by U.S. Pat. No. 5,166,851 to Jacobson, a co-inventor of the present invention, which includes an audiotape or microchip-based recording and reproducing means non-removably enclosed in a durable mailer casing suitably protecting said means from activation or breakage during transit, and optionally further includes a crevice space adapted to receive enclosures such as letters or photographs.

In the product promotion context, retail vendors have sometimes employed "point of sale" audio devices whereby a prerecorded message imparts information or a "sales pitch" to potential buyers in store foyers or aisles adjacent products; U.S. Pat. No. 2,517,181 to Davis is an early disclosure of such a system; a more modern "point of sale" promotional device activated by an ultrasonic electronic sensor which senses the presence of a person within a certain radius of the product, and is somewhat portable in nature, has been disclosed in U.S. Pat. No. 4,670,798 to Campbell et al.

Another not uncommon practice in the general audio recording communication field is the use by individuals of miniature tape recorders, sometimes in novelty configurations such as "pens" having a built-in short duration continuous tape loop, for the purpose of dictating reminders and "notes" to themselves, regarding "things to do" and the like. Hand-held recordable microchip self-reminder devices are also commercially available.

All such known recorded audio communication practices and disclosures, however, have significant limitations or shortcomings which the present invention is designed to overcome.

It is the multiple object of this invention to expand the scope of-, improve upon- and make more convenient recorded audio message conveyance-, audio mail-, audio product promotion- and self-reminder practices, as further detailed below:

1. Message Conveyance

The above-mentioned telephone answering machines sometimes used by householders to leave recorded audio messages for each other are stationary objects, frequently placed inconspicuously in room corners, and are not movably placeable in conspicuous locations around the house or apartment; therefore audio messages placed on said machines (particularly at times when the receiver is not in the habit of inspecting the machine for messages) may be overlooked by the intended receiver. Desktop personal computers which have a message/reminder feature are likewise typically placed in a fixed location on a desk or table within the household, and messages left thereon are likewise subject to being overlooked.

A limited solution to the problem of overlooked messages is disclosed by U.S. Pat. No. 5,241,427 to Lin, which teaches a microchip circuit message recording and playback device attached to the interior of a front door adjacent the knob, activated by an incoming person's use of his or her front door key. However, this allows for placement of recorded messages in but one more permanent location and is therefore not useful for certain types of intra-household messages.

Specifically, the above-mentioned message conveyance devices and methods do not allow for the temporary mounting of audio messages in any desired conspicuous location within a residence. Such temporary placement may be desirable, for example, when a member of a household wishes to leave an important audio message for another household member after the person to whom the message is being directed has gone to sleep, in situations where the person leaving the message will themselves be sleeping or away in the morning; the sender would naturally wish to leave said message secured in a place the receiving party is sure to notice and play back immediately upon arising, such as mounted on a clock radio or bathroom mirror.

The present invention enables a user to easily, non-permanently fasten a microchip recording and playback apparatus containing a recorded voice message or other audio information to selectable household surfaces or objects, such as doors, walls, mirrors, bulletin boards or calendars, in locations and along the sightline the user deems most desirable and likely to be timely noticed, activated and heard by the intended receiver.

The present invention has the further advantage over stationary answering machines and desktop personal computers of enabling a user to record a message which the receiving party can take with them and activate at a later time, prompting the receiving party to remember something they might otherwise forget; for example, when a parent wishes to aurally remind a school child of an after-school appointment, the present invention enables the parent to record a message to that effect and non-permanently affix it to the child's notebook or lunchbox, for activation at the end of the school day. This method of conveying reminders between separated householders (who are not directly reachable by telephone call at a fixed location), is far more convenient and less costly than the available alternatives, such as the carrying by the receiving party of either a beeper (with or without a scripted message capability) or cellular telephone.

2. Audio Mail

The above-mentioned transiting of recorded messages by sending cassettes through the mail (or alternate postal-type carriers) does not allow for the activation of the audio message immediately upon receipt of the mailer or package containing said cassette; rather the recipient must locate a tape player and insert the cassette inside. Where a recipient either does not own a tape player, or has one which is broken (or lacks charged batteries), there can be substantial delay in receipt of the audio message, and preparation of a reply. It is therefore desirable and more convenient to transit recorded audiotape messages with an accompanying recording and reproducing means whereby the recipient can activate the audio message immediately upon receipt of the vessel in which it is mailed, and re-use same to record a reply to the sender, or otherwise.

The self-contained "audio mailer" disclosed in U.S. Pat. No. 5,166,841 to present co-inventor Jacobson, which includes a non-removable recording/reproducing means and a storage medium means, permits such immediate receipt of messages and is adaptable for re-use, but teaches only a limited solution with respect to the problem of transiting audio messages with enclosures: While a small-dimensioned reusably designed "audio mailer" with a built-in recording/reproducing means is a practical modality for transiting audio messages alone or with small, standard-sized documentary enclosures, such as letters or photographs, it is not a practical or efficient modality for transiting audio messages with all manner of sized- and shaped enclosures, goods and products mailed and shipped in commerce.

A wide variety of sized- and shaped conventional mailers, packaging- and shipping vessels are commercially available to which a (suitably protected) recordable microchip apparatus could easily be non-permanently fastened, temporarily converting the same into "audio mailers," "audio packages" or "audio crates"; this would obviate the need to manufacture versions of every sized- and shaped mailing-, packaging- and shipping vessel (required to accommodate enclosed items of the myriad sizes and shapes sent in commerce) with a built-in audio recording/reproducing and storage medium means. In addition to being more practical and efficient, said temporary equipping of ordinary mailing-, packaging- and shipping vessels with an audio recording/reproducing apparatus would prevent considerable wastage since most non-standard-sized mailing-, packaging- and shipping vessels equipped with a built-in recordable microchip or miniaturized magnetic tape recorder (e.g. in a tape loop configuration) would likely be disposed of after a single use.

The present invention enables a user to easily, non-permanently fasten a suitably protected and designed microchip audio recording and playback apparatus containing a recorded voice message or other audio information to interiors of the plurality of sized- and shaped mailing-, packaging- and shipping vessels used in commerce, said suitable design protecting it against unauthorized accidental or intentional activation or breakage during mail or alternate postal-type conveyance.

3. Audio "Point of Sale" Product Promotion

The above-mentioned audio promotion "point of sale" devices require potential customers to be in physical proximity to the good being offered for sale, and have therefore traditionally been placed in store foyers or aisles adjacent products; it has not heretofore been considered practicable to address such "point of sale" audio messages to recipients of goods sent to individuals on a trial, non-obligation or unconditionally returnable basis by mail or alternate postal-type carrier, such as, for example, Book Of The Month Club offerings and the like. Such potential customers, however, may be equally if not more receptive to such audio "sales pitches" than persons browsing store foyers or aisles inasmuch as they have typically already expressed positive interest in the product prior to receiving it on a trial, non-obligation or returnable basis, and would likely be paying direct attention to the product upon unwrapping it at the time they activated and listened to the audio message (from e.g. the author, company president, etc.).

The present invention enables vendors of goods and products sent to potential customers on a trial, non-obligation or returnable basis by mail or alternate postal-type carrier to easily, non-permanently fasten a (suitably protected) recording and playback apparatus containing an audio "point of sale" informational message or "sales pitch" directly upon products or goods, or elsewhere in the interiors of the mailing or packaging vessels in which they are sent. Because it is easily reusable, the apparatus also serves as a gratuity to recipients for said audio product promotion purposes, and may have embossed on its housing exterior the sending company's name or logo for publicity purposes during the course of its subsequent re-use.

The invention may also be employed for the conveyance upon home delivery of certain mail order products or those purchased via television, of an audio message of thanks or salutation to customers from a company's president. For example, goods purchased from "home shopping" television programs could appropriately be shipped with an "audio thank you note," consistent with the transaction's origin from an electronic audio/visual sales pitch.

In a related vein, the present invention may also be employed when a product's vendor wishes to convey an audio commendation of the product's virtues along with a complimentary product sent to a non-purchaser whose approval or endorsement is desired; for example, a book publisher may include personal words of praise from himself or an admirer of the author with complimentary copies of just-published books sent to print and media book reviewers, in hopes of encouraging them to select the work for a (hopefully favorable) review. Likewise, a record company executive or recording artist might include a brief sample of a song and/or a verbal appeal for airplay with the shipment of complimentary copies of the artist's latest compact disc to radio station executives and disc jockeys.

4. Self-Reminders

The above-mentioned miniature tape recorders used for dictating self-reminders are generally carried loose in pockets, brief cases or purses and are not fashioned to be fastened, nested or conjoined for storing or carrying purposes with related compatible objects such as datebooks, address books and the like. The commercially available microchip self-reminder devices are likewise hand-held items. A novelty "pen" with a built-in tape loop can be loosely clipped onto vest pockets, datebook jackets and the like, but is likewise a non-securable object which can easily fall off unnoticed, and thereby be lost and unavailable. In that event, a person consulting his or her appointment- or datebook, for example, and wishing to dictate a self-reminder pertaining to an entry therein, would not immediately be able to do so.

The present invention enables a user to easily, non-permanently fasten a recording and playback apparatus for reciting self-reminders to the exteriors or interiors of related compatible objects the user always carries with them, or keeps close at hand, such as a briefcase, datebook, address book and the like, giving them the ability to record such self-reminders at any and all times.

Additional Purposes and Uses

The above-described purposes and applications are not to the exclusion of numerous, diverse additional uses to which the present invention may be put, such as for the conveyance with shipped products of audio warnings (to supplement printed warning labels) or audio "special handling" instructions; or the mailing by politicians of a audio message of thanks or solidarity with package-sized enclosures of campaign paraphernalia such as yard signs, bumper-stickers and/or trinkets with the politician's name embossed upon them.

All of the above-mentioned non-individual or household uses requiring conveyance of the identical audio message to numerous receiving parties may be efficiently and conveniently accomplished by computer assisted programming of selected vocal messages or other audio information for multiple units of the present apparatus simultaneously, as further detailed below in Description of the Embodiments of the Invention.

The present invention then, forms a supplemental option among the arsenal of known communicative methods and instruments, such as telephone calls, answering machine messages, separately conveyed audiotape cassettes, said "audio mailer" previously disclosed by co-inventor Jacobson, and written notes of the "post-it" type and others. ("Post-it" is a registered trademark of the 3-M Company). As such, it is designed with the requirements of inexpensive mass production and use, light weight, low retail and transit costs, and ease of reuse in mind.

Tangentially hereto, audio recording- and/or reproducing devices, and/or associated storage medium means, have previously been disclosed and claimed for message conveyance purposes as: an intra-household message device secured to the inward front door knob and activated by the turning key of a person entering the house [Lin]; a door actuated message device with a quick attach-detach mounting bracket [Slack et al.]; and as a message conveyance system by which persons at the front door of a residence can route a message to the resident's telephone answering machine [Lipscher et al.]. Said devices and means have previously been disclosed and claimed for audio mail purposes as: mailers customized to receive individual audiotape cassettes, with or without further enclosures [Smith] [Ellis] [Silengo]; and as a self-contained "audio mailer" having in certain embodiments a space adapted to receive indicia [Jacobson]. Said devices and means have previously been disclosed and claimed for product promotion or conveyance purposes as: a portable "point of sale" audiotape playback device with a hook-shaped means of securement to automobile windows and household doors [Lunsford]; and as a combined insignia and small merchandise display [Tarrant, 1980]. Said devices and means have also been disclosed and claimed for personal entertainment purposes with VELCRO-type means of attachment to the human torso [Ekman et al.], the human arm [Curley] and bicycle handlebars [Rogowski].

BRIEF DESCRIPTION OF THE DRAWINGS

FIG. 1 is a perspective top front right side view of an audio microchip recording and reproducing circuit, storage medium and related circuitry, in a housing enclosure. The push-button record/playback controls of the apparatus, and a mechanical color-coded slide exposure system for signaling the presence or absence of a waiting message, are shown along the first joining wall of the housing. Openings for audio input directed to the microphone, and audio output from speaker, are shown upon the housing's first side wall, and a stack of adhesive stickers attached to the housing's second side wall, is partially shown.

FIG. 2 is a perspective bottom rear left side view of a plurality of stacked "pressure sensitive" adhesive stickers attached to the first side wall of said housing.

FIG. 3 is a top plane view of an audio microchip recording and reproducing circuit, storage medium and related circuitry in a housing enclosure, fastened by means of said stacked "pressure sensitive" adhesive stickers to a selectable surface or object.

FIG. 4 is a partially broken away front view of an audio microchip recording and reproducing circuit, storage medium and related circuitry, and operatively cooperating microphone, speaker and battery power source, mounted on the first side wall of the housing.

FIG. 5 is a perspective top front right corner view of an alternative embodiment of said audio microchip recording and reproducing circuit, storage medium and related circuitry in a housing enclosure, designed for use in the interiors of mailing vessels, packages and shipping containers. The record/stop/playback control switch of the apparatus, and a clip-on covering sheath safeguarding said switch from inadvertent or unauthorized operation, are shown.

FIG. 6 is an exploded rear view of an alternative embodiment, a conjoinable housing and independent plate, employing a "tongue and groove" conjoining system; a "pressure sensitive" adhesive sticker attached to the underside of said conjoinable plate is shown. A non-adhesive peel-off cover strip applied to the undersurface of said sticker is also shown.

FIG. 7 is a partially broken away top plan view of said "tongue and groove" conjoining system, with said housing and independent plate conjoined. An electronic blinking light system for indicating the presence of a waiting message is also partially shown.

FIG. 8 is a partially broken away top plan view of an alternative embodiment designed for non-permanently fastening the apparatus to magnetic-conductive surfaces, such as refrigerator doors; two small magnets affixed to the second side wall of the housing are shown.

FIG. 9 is a partially broken away top plan view of an alternative embodiment; a suction cup made of rubber or similar synthetic material affixed by screw to the upper portion of the second side wall of the housing is shown.

FIG. 10 is a partially broken away top plan view of another alternative embodiment; the second side wall of the housing is lined by high adhesion substance with VELCRO hook material, and is engaged to a separate companion piece of VELCRO gauze of substantially identical size and dimension, which is itself non-permanently affixed by medium adhesion substance to a selectable surface, object or interior of a mailing vessel, package or shipping container.

FIG. 11 is a partially broken away perspective view of a mailing box with the apparatus removably nested in a protective C-shaped jacket made of styrofoam or other shock-absorbent material which is mounted on the underside of a box sleeve; said jacket is adhesively secured to said mailing box sleeve.

FIG. 12 is a transverse section of 12—12 of FIG. 11 partially broken away with the housing in phantom.

FIG. 13 is a partially broken away perspective rear view of a durable mailer with a foldable "pop-up" holder adhesively secured to a side wall of a durable mailing vessel.

FIG. 14 is a perspective rear view of a partially folded "pop-up" holder with a foldable support strip integral therewith and perpendicular thereto, adhesively secured to a side wall of a durable mailing vessel.

FIG. 15 is an exploded view of said foldable holder adhesively secured to a side wall of a durable mailing vessel, with a "pop-up" nesting area of corresponding size and dimension as the receivable apparatus housing.

FIG. 16 is a perspective bottom rear left side view of a plurality of stacked "pressure sensitive" adhesive stickers attached to the first side wall of said housing, each sticker bearing the inscription AUDIO MESSAGE ENCLOSED on its oversurface.

DESCRIPTION OF THE EMBODIMENTS OF THE INVENTION

Figure 11:
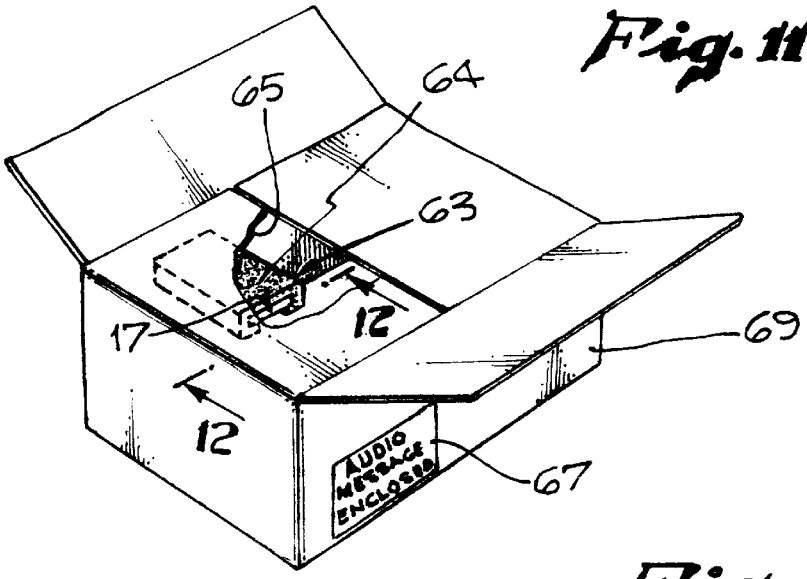
FIGS. 11–16 show alternative embodiments designed for use in the interiors of mailing vessels, packages or shipping containers.

In its preferred embodiment for intra-household message conveyance the present invention includes an audio microchip recording and reproducing circuit, storage medium and operatively cooperating microphone, speaker, power source, non-removably enclosed in a lightweight, injection-molded plastic housing including first and second side walls and joining walls. The preferred embodiment further includes push-button record and playback controls positioned upwardly along the right joining wall for ergonomic ease of use (when the apparatus is hand-held for recording purposes prior to stick-on application), along the first joining wall. An adhesive sticker "stick-on" fastening means integral with said second side wall of said housing and a stack of overlying identical stickers, for non-permanently mounting the apparatus upon selectable surfaces or compatible objects in any desired temporary location, is also employed in the preferred embodiment. All of said elements form in the preferred embodiment an apparatus for providing recorded voice messages or other audio information in any desired temporary location, approximately 2¼" (width)×4" (length)×½" (depth), and weighing approximately 6 ounces.

In the preferred embodiment, said microchip recording and reproducing circuit and storage medium components are adhered on a circuit board in the conventional manner, optionally utilizing surface mounting and/or "chip on board" techniques; said circuit board is attached to the undersurface of said first side wall of said housing by glue or tape. Commercially available Information Storage Device's (ISD-TM) brand integrated circuit nonvolatile memory microchips may be employed in the preferred embodiment; said ISD microchip products comprise waveform, single chip voice messaging recording and playback systems which, when equipped with operatively cooperating power source, microphone, speaker and record/playback controls, provide between 10 and 90 seconds of telephone grade voice recording and playback (depending on the model). Said "chipcorder" art was disclosed and elaborated in U.S. Pat. No. 4,890,259, No. 4,989,179, No. 5,126,967 and No. 5,164,915 to Simko and U.S. Pat. No. 5,220,531 to Blyth and Simko. (ISD is a registered trademark of Information Storage Devices. "Chipcorder" is a pending registered trademark of Information Storage Devices.)

The ISD microchip integrated circuit records any voice or other sound signal within a passband of 3.4 kHz and, using no power, retains the information for years. During recording, the ISD microchip circuit passes the signal to a transceiver stage which writes it into a storage array. As with a conventional digital EEPROM, storage takes place on the nonvolatile floating gate of a MOS transistor which acts like a small capacitor whose decay time is measured in years. The ISD microchip circuit meters a variable charge to each gate through an intelligent writing scheme. During playback, the stored voltages are sequentially read from the storage array under the control of an 8 kHz clock. After smoothing and filtering, the signal is amplified and fed to the speaker. The recorded voice or other sound signal is preserved on the ISD storage array for repeat playback until said voice or other sound signal is "recorded over" by a new voice or sound signal.

Said system has proven to be technically and economically viable in recordable greeting cards; the recordable greeting card was first disclosed by U.S. Pat. No. 4,791,741 to Kondo on Dec. 20, 1988, and was made commercially available in the United States in or about January, 1994. See Rigdon, Wall Street Journal, "Hallmark, American Greetings' Cards To Send a Real Earful for a Loved One." Nov. 5, 1993, A7B.

Those skilled in the art are further referred to a detailed description of the features and operation of said ISD recordable microchips found in the Application Notes and Design Manual for ISD's Single-Chip Voice Record/Playback Devices, July 1994, distributed and copyrighted by Information Storage Devices, 2841 Junction Avenue, San Jose, Calif. 95134. For example, a detailed description and illustration of a record/playback circuit with push-button controls may be found in said Application Notes and Design Manual at pages 26–27 thereof.

In its preferred embodiment, the present apparatus may further include a mechanical slide exposure system for indicating the presence of a waiting recorded message, by means of color-coded panels and/or the corresponding words or initials "Message Waiting" (MW) or "Free to Record" (FR), or similar indicia. The apparatus may alternately include a blinking light system operatively cooperating with the power source to indicate the presence of such a recorded message.

In an alternate embodiment utilizing longer than 10 second duration microchips, said audio microchip recording and storage durational capacity may be filled in segments, whereby the user may record and store multiple separate recordings of a set duration, for example 10 seconds (or longer), or of random length (up to the durational capacity of the microchip), and separately retrieve (and/or re-record over) said messages. Said alternate embodiment may further include a mechanical slide exposure system or blinking lights indicating the presence or absence of waiting recorded messages in said segments.

In the preferred embodiment a plurality of stacked "pressure sensitive" adhesive stickers is attached to said second side wall of said housing, each sticker having its undersurface adhesively secured to an identical sticker by a medium adhesion substance whereby the apparatus may be easily, non-permanently fastened to selectable surfaces (such as doors, walls, mirrors, etc.) or compatible objects (such as calendars, bulletin boards, appointment- or datebooks, etc.), upon contact between the outermost (i.e. exposed) of said stacked stickers' undersurface and said surfaces or objects, and be easily removed from same; and whereby subsequent to said removal (as necessary) said outermost exposed sticker may be easily peeled off from said stack so that a new outermost sticker with fresh adhesive may be exposed.

The innermost sticker (flush against the second side wall of the housing) is affixed to the housing by a high adhesion substance so that said plurality of stacked stickers are all firmly attached to- and form a part of the apparatus. The medium adhesion substance applied to the undersurface of said plurality of stacked "pressure sensitive" stickers is of the type which permits the user to firmly secure the apparatus to surfaces but is not permanently binding, permitting the user to remove the apparatus from said selectable surfaces and objects with reasonable ease and without harming the apparatus, surfaces or objects.

In an alternative embodiment designed for use in mailing vessel-, package- or shipping container interiors, the oversurface of said adhesive stickers may bear the inscription AUDIO MESSAGE ENCLOSED (or similar words) such that a spare sticker (if available) may be placed on the exterior of said mailing vessel, package or shipping container as an advisory to the recipient of the presence of an audio message inside.

In said alternate embodiment designed for use in mailing vessel-, package- or shipping container interiors said record/playback controls are positioned in a sliding switch record/stop/play format along the first joining wall of the apparatus, and further safeguarded to preclude unauthorized or inadvertent activation during transit by a clip-on covering sheath engagable with indented areas of corresponding size and dimension located on the side walls of said housing adjacent said sliding switch.

In said alternate embodiment designed for use in mailing vessel-, package- or shipping container interiors, said microchip recording/reproducing circuit and storage medium may be capable of receiving programming of selected vocal messages or other audio information simultaneously with multiple other units. Said commercially available ISD microchips may be employed with a multiple unit programming system which consists of IBM (TM) personal computer (PC) Compatible (386 model or better) based hardware and software, including an internal 8-Bit PC add-in digital board, an external desktop programming module, and a commercially available 8-Bit analog sound board, the Sound Blaster Pro Basic (™). (IBM is a registered trademark of International Business Machines. Sound Blaster is a registered trademark of Creative Labs.) Said ISD system allows the user to simultaneously program up to eight recordable microchip units with the identical voice message or audio information, said reproductions each being a "master" identical in quality to the original. Those skilled in the art are referred to a detailed description of the features and operation of said ISD multiple unit programming system found in the above-referenced ISD Application Notes and Design Manual, at page 55.

In an alternative embodiment, one or more suction cups affixed by screws to said second side wall of said housing may be employed as said "stick-on" means for non-permanently fastening the apparatus upon selectable surfaces or compatible objects in desired temporary locations. In this alternative embodiment, the user non-permanently fastens the apparatus to said surfaces and objects by compressing the suction cup or cups against said surfaces or objects to form a vacuum seal.

In another alternative embodiment, one or more magnets affixed by high adhesion substance to said second side wall of said housing may be employed as said "stick-on" means for non-permanently fastening the apparatus upon selectable magnetic-conductive surfaces or compatible objects (such as refrigerator doors) in desired temporary locations. In this alternative embodiment, the user non-permanently fastens the apparatus to said magnetic-conductive surfaces or objects by placing said magnet or magnets affixed to said housing in contact with said magnetic-conductive surfaces.

In another alternative embodiment, a conjoinable housing and independent plate, and a "tongue and groove" conjoining system, may be employed. In said alternative embodiment said second side wall of said housing has an indented grooved area extending from the bottom thereof to a stopper area approximately ¼" from the top, permitting the housing to be slidably engaged to a companion injection-molded plastic plate with a protruding tongue area of corresponding size and dimension to said grooved area. In said alternative embodiment, the underside of said companion plate has affixed thereto a medium adhesion "pressure sensitive" sticker, or plurality of stacked stickers, of the type which permits the user to firmly secure the plate to selectable surfaces but is not permanently binding, permitting the user to remove said plate from said selectable surfaces with reasonable ease and without harming the plate, apparatus or surfaces. In this embodiment, the user fastens the apparatus in desired temporary locations by fastening said independent plate to said selectable surfaces and then sliding the grooved area of said housing upon the tongue area of said plate.

In certain alternative embodiments, said "stick-on" fastening means is integral with an article independent of and engagable with said housing. In one such alternative embodiment designed for use in mailing vessel-, package- or shipping container interiors and to safeguard the apparatus against activation or breakage during transit, said housing is nestably engaged to an independent protective jacket holder made of styrofoam or other shock-absorbent material having carved therefrom a concave area of substantially identical size and dimension as said housing. In said alternative embodiment, the underside of said protective jacket holder contains an adhesive substance of the type which permits the user to firmly secure said jacket holder to mailing vessel-, package- or shipping container interiors. In said alternative embodiment, the user fastens said apparatus to the interiors of said desired mailing vessels, packages or shipping containers by fastening said independent protective jacket to said interiors and then snugly, removably nesting said housing in said protective jacket.

In another such alternative embodiment designed for use in the interiors of durable mailing vessels, packages or shipping containers, said housing is slidably engaged to a foldable holder with a "pop-up" nesting area of substantially identical size and dimension as said housing. In said alternative embodiment, the underside of said pop-up holder contains an adhesive substance of the type which permits the user to firmly secure said foldable "pop-up" holder to said mailing vessel-, package- or shipping container interiors. In said alternative embodiment, the user fastens said apparatus to the interiors of said durable mailing vessels, packages or shipping containers by adhesively fastening said independent foldable holder to said interiors and then snugly, removably nesting said housing in said pop-up nesting area of said foldable holder.

In another such alternative embodiment designed for use on selectable surfaces, objects or mailing vessel-, package- or shipping container interiors, the underside of either of said housing, plate, protective jacket or pop-up holder (depending upon the embodiment) is lined by high adhesion substance with VELCRO hook material; said VELCRO hook material is engagable with an independent companion piece of VELCRO gauze (or similar substance) of substantially identical size and dimension having on its underside a "pressure sensitive" medium adhesion substance. Said medium adhesion substance is of the type which permits the user to firmly secure said independent piece of VELCRO to surfaces but is not permanently binding, permitting the user to remove said piece of VELCRO from said selectable surfaces with reasonable ease and without harming the apparatus or surfaces. In this embodiment, the user fastens the apparatus in said desired temporary locations by fastening said independent piece of VELCRO gauze to said selectable surfaces, objects or interiors, and then engaging said VELCRO hook material on the undersurface of said housing, plate, protective jacket or "pop-up" holder with said companion piece of VELCRO gauze (and where said plate, protective jacket or "pop-up" holder are employed, further conjoining said housing with said plate, protective jacket or "pop-up" holder).

Referring to the drawings and particularly to FIG. 1, a lightweight injection-molded plastic housing 17 encloses a mounted audio microchip recording and reproducing circuit, storage medium and related circuitry; said housing includes openings 19, 20 in the first side wall 18 thereof for audio input directed to the microphone and audio output directed from the speaker, respectively. Push-button record/playback controls 22 are positioned upwardly along the first joining wall for ergonomic ease of use (when the apparatus is hand-held for recording purposes prior to stick-on application). After recording a message the user manipulates the switch 23 of a mechanical color-coded slide exposure system downward to expose a red area 24, signaling the presence of a "message waiting" (MW). Upon hearing said message the receiving party may manipulate the slide exposure switch 23 upward to expose a green area 25, signaling that the apparatus is "free to record" (FR).

Referring to FIG. 2, a plurality of stacked "pressure sensitive" adhesive stickers 27 is affixed (as further detailed below) to said second side wall 28 of said housing 17. Each sticker 29 has its undersurface secured to an identical sticker by a medium adhesion substance 30, whereby the user may easily non-permanently fasten the apparatus to selectable surfaces or objects in any desired temporary location by placing the outermost (i.e. exposed) of said stacked stickers' undersurface 31 in contact with said surfaces or objects.

Referring to FIG. 3, a top view of said stacked adhesive stickers 27 is shown. The innermost sticker 32, flush against the second side wall of the housing, is affixed to the housing by a high adhesion substance so that said plurality of stacked stickers 27 are all firmly attached to- and form a part of the apparatus. The medium adhesion substance (FIG. 2—30, 31) applied to the undersurface of each of said stacked "pressure sensitive" stickers (FIG. 2, 29) is of the type which permits the user to firmly secure the apparatus to surfaces 33 or compatible objects but is not permanently binding, allowing the user to remove the apparatus from said surfaces 33 with reasonable ease and without harming the apparatus, surfaces 33 or objects.

Referring to FIG. 4, a commercially available ISD audio recording and reproducing integrated circuit nonvolatile memory microchip die, storage medium and related circuitry 34 is adhered on a circuit board 35 in the conventional manner, optionally utilizing surface mounting and/or "chip on board" techniques. Said memory microchip die, storage medium and related circuitry 34 operatively cooperates with a microphone 37, speaker 38 and battery power source 39. Said circuit board is mounted to the undersurface of said first side wall of said housing 18 by glue or tape.

Referring to FIG. 5, in an alternate embodiment designed for use in the interiors of mailing vessels, packages or shipping containers, record and playback modes are controlled by a sliding switch 39 positioned upwardly along the first joining wall 21 of the apparatus. The apparatus is further safeguarded to preclude unauthorized or inadvertent activation during transit by a clip-on covering sheath 42 which is engagable with indented areas 43 of corresponding size and dimension located on the side walls 18, 28 of said housing 17 adjacent said sliding switch 39. Referring to FIG. 6, in an alternative embodiment, a conjoinable injection-molded plastic housing 44 and independent companion injection-molded plastic plate 45, and a "tongue and groove" conjoining system, is employed. The second side wall 47 of said housing 44 has an indented grooved area 48 extending from the bottom of said second side wall to a stopper area 49 approximately ¼" from the top. Said companion injection-molded plastic plate 45 has a protruding tongue area 50 of corresponding size and dimension to said housing's grooved area 48. The underside 51 of said companion plate 45 has affixed thereto a medium adhesion "pressure sensitive" sticker 52 of the type which permits the user to firmly secure said plate 45 to surfaces but is not permanently binding, and which permits the user to remove said plate 45 from selectable surfaces with reasonable ease and without harming the said plate or surfaces. The user fastens the apparatus to selectable surfaces or objects in any desired temporary location by fastening said plate 45 to said surfaces or objects and then sliding the grooved area 48 of said housing 44 upon said tongue area 50 of said plate 45. A non-adhesive peel-off cover strip 53 common to all adhesive sticker embodiments, protects the user's fingers from contact with adhesive during initial handling prior to the first application to surfaces.

Referring to FIG. 7, a top view of said "tongue and groove" conjoining system, with said housing 44 and independent companion plate 45 conjoined, is shown. The user fastens the apparatus to selectable surfaces 33 or objects in any desired temporary location by fastening said plate 45 to said surfaces 33 or objects and then sliding the grooved area 48 of said housing 44 upon said tongue area 50 of said plate 45. A blinking light 53 system operatively cooperating with said power source, to signal the presence of a waiting recorded message—an alternative embodiment to said mechanical color-coded signalling system—may be employed in this and other alternative embodiments.

Referring to FIG. 8, two small magnets 54 are affixed by high adhesion substance to said second side wall 28 of said housing 17; the user non-permanently fastens the apparatus to a magnetic-conductive surface 55 or object (such as a refrigerator door) in any desired temporary location by placing the magnets 54 in contact with said surface or object 55.

Referring to FIG. 9, a suction cup 57 made of rubber or similar synthetic material is affixed with a screw 58 to the upper portion of said second side wall 28 of said housing 17; another small suction cup (unseen) is affixed to the lower portion of said second side wall of said housing. The user non-permanently fastens the apparatus to a selectable surface 33 or object in any desired temporary location by placing said suction cups 57 upon said surface 33 or object and pushing with sufficient force to create a vacuum seal between the undersurface of said suction cups and said surface 33.

Referring to FIG. 10, a piece of gauze with VELCRO stick-on, fastening means independent of and engagable with said housing 17, is employed. Said second side wall of said housing 17 is lined by high adhesion substance 59 with VELCRO hook material 60. An independent companion piece of VELCRO gauze 61 of substantially identical size and dimension as said VELCRO hook material has on its undersurface a medium adhesion substance 62, permitting the user to non-permanently secure said independent companion piece of VELCRO gauze 61 to selectable surfaces 33 or objects. The user non-permanently fastens the apparatus to said surfaces 33 or objects in any desired temporary location by adhesively fastening said independent companion piece of VELCRO gauze in said desired location and engaging said VELCRO hook material 60 with said independent companion piece of VELCRO gauze 61.

Referring to FIG. 11, an embodiment designed for use in the interiors of mailing vessels, packages or shipping containers, another article with stick-on, fastening means independent of and engagable with said housing 17 is employed. An independent protective jacket holder 63 made of styrofoam or other shock-absorbent material has carved therefrom an open-ended C-shaped concave area of substantially identical size and dimension as said housing 17. The undersurface 64 of said protective jacket holder contains an adhesive substance permitting the user to firmly secure said jacket holder to the underside of a box sleeve 65 or to other mailing vessel-, package- or shipping container interiors. The user non-permanently fastens said apparatus to said package interior by adhesively fastening said protective jacket holder 63 to said box sleeve 65 and then snugly, removably nesting said housing 17 in said C-shaped concave area of said protective jacket holder 63. An adhesive sticker 67 bearing the inscription AUDIO MESSAGE ENCLOSED on the oversurface thereof, optionally retrieved from said stacked stickers affixed to said second side wall of said housing (FIG. 16) in certain embodiments, may be placed upon the exterior of said mailing vessel, package or shipping container as an advisory to recipients of the presence of an audio message inside.

Figure 12:
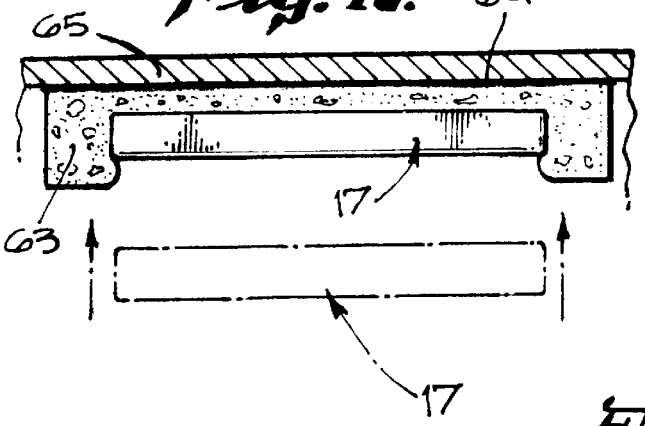

Referring to FIG. 12, said housing 17 is snugly, removably nested in said concave area of said protective C-shaped styrofoam jacket 63; said protective jacket's open-ended C-shape secures the housing in place; the apparatus thereby safeguards recorded messages against activation or breakage during transit. Said styrofoam jacket material is sufficiently flexible to permit the housing to be received directly, as shown in phantom 67, or slidably from either end.

Figure 13:
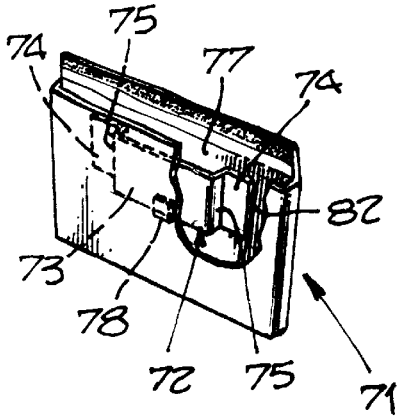
Figure 14:
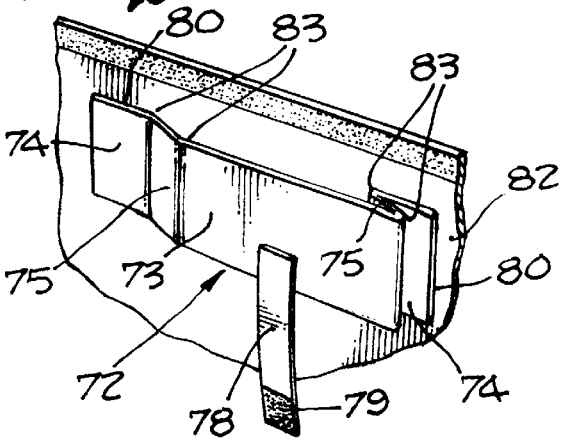
Figure 15:
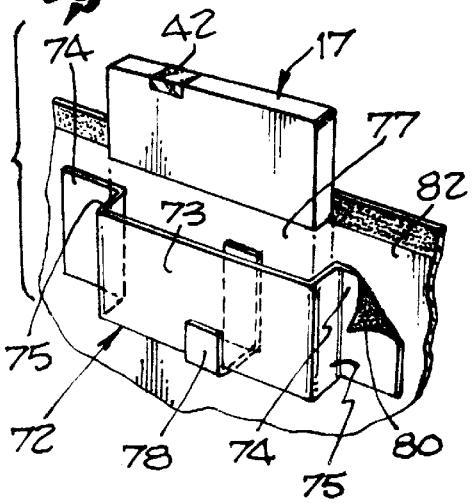

Referring to FIGS. 13–15, another embodiment designed for use in mailing vessel-, package- or shipping container interiors, having a stick-on fastening means independent of and engagable with said housing 17, is employed. A foldable holder 72 formed in a 4-fold 83 configuration includes a center leaf 73, end leaves 74 and joining leaves 75. Said center leaf 73 has integral therewith a foldable support strip 78 (slightly longer in length than the width of said center leaf 73) perpendicular thereto extending downward (FIG. 14). When affixed to an interior surface 82 of a durable mailing vessel 71 said foldable holder is then "popped-up" by hand (by extending said joining leaves 75 perpendicularly from said interior surface) to form a nesting area 77 of substantially identical size and dimension as said housing. Said end leaves 74 and support strip 78 have on their undersurface an adhesive substance 79, 80 respectively, permitting the user to fasten said foldable "pop-up" holder 72 to said mailing vessel interior 82. The user non-permanently fastens said housing 17 (which includes in said mailing embodiment a clip-on protective cover sheath 42) to said interior 82 of said durable mailing vessel 71 by adhesively fastening said foldable "pop-up" holder 72 to said interior via the end leaves and support strip thereof, and then snugly, removably inserting said housing 17 in said "pop-up" nesting area 77.

Figure 16:
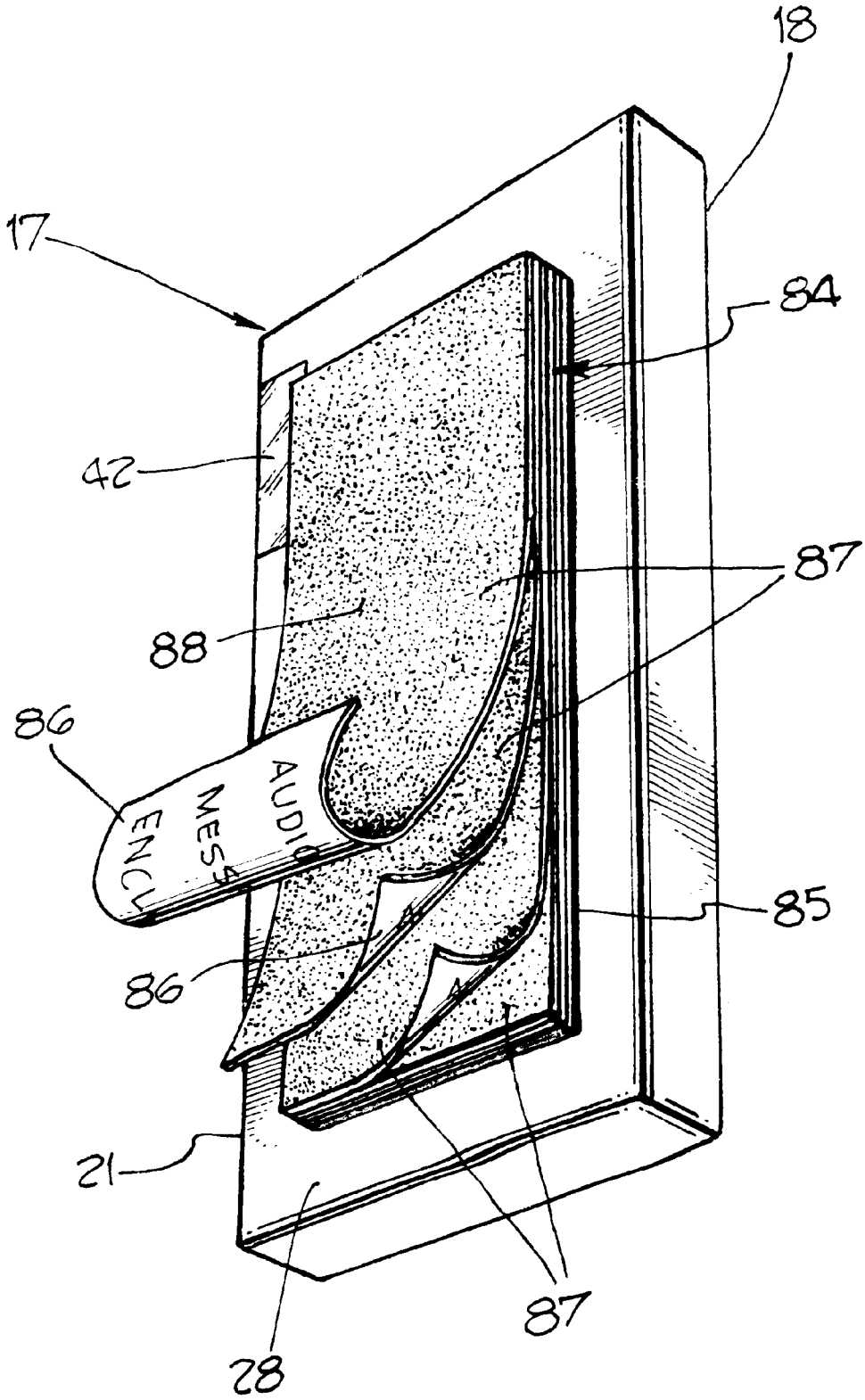

Referring to FIG. 16, another embodiment designed for use in mailing vessel-, package- or shipping container interiors, a plurality of stacked "pressure sensitive" adhesive stickers 84 is employed, as in FIGS. 2 and 3. The innermost sticker 85, flush against the second side wall of the housing 17, is affixed to the housing by a high adhesion substance so that said plurality of stacked stickers 84 are all firmly attached to- and form a part of the apparatus. Each sticker 86 has its undersurface secured to an identical sticker by a medium adhesion substance 87 whereby the apparatus may be easily, non-permanently fastened to a selectable mailing vessel-, package- or shipping container interior upon contact between the outermost (i.e. exposed) of said stacked sticker's undersurface 88 and said interiors. The medium adhesion substance 87, 88 applied to the undersurface of each of said stacked "pressure sensitive" stickers 86 is of the type which permits the user to firmly secure the apparatus to mailing vessel-, package- or shipping container interior but is not permanently binding, allowing the user to remove the apparatus from said interiors with reasonable ease. In said mailing embodiment, each said adhesive sticker 86 bears the inscription AUDIO MESSAGE ENCLOSED on its oversurface such that a spare sticker (if available) may be placed on the exterior of said mailing vessel, package or shipping container as an advisory to the recipient of the presence of an audio message inside.

While the invention is shown and detailed in a preferred and alternate embodiments, variations in embodying the invention may be practiced. For example, a fastening means other than adhesive, VELCRO or similar substance, magnet or a suction cup may be employed, such as a clamp, hook or elastic band system. Additional variations may include: a fastening means comprised of a plurality of stacked adhesive stickers with a non-adhesive peel-off cover strip between each of said stickers; a fastening means comprised of a single adhesive sticker with or without a non-adhesive cover strip; a miniaturized audio recording and reproducing means and storage medium means other than an audio microchip circuit and storage medium, such as conventional magnetic tape recording and reproducing means employing a micro-cassette or tape loop mechanism; an apparatus which includes means for testing or indicating battery strength; and an apparatus alternatively or exclusively powered by a non-battery power source, including an electrical outlet.

These and other modifications of and departures from the specific preferred and alternate embodiments described herein may be made without departing from the inventive concept and the spirit and scope of the appended claims. The invention is therefore not to be limited except as set forth in the claims which follow and within the doctrine of equivalents.

What is claimed is:

1. An apparatus for bearing and temporarily positioning audio information, comprising:

(a) an audio microchip for recording and reproducing said audio information;

(b) an audio microchip storage medium for storing said audio information; and (c) fastening means for non-permanently securing said audio microchip and storage medium to any surface;

(d) said fastening means including a plurality of stacked adhesive stickers, each stacked adhesive sticker having on its undersurface a medium adhesion substance, whereby said audio microchip and storage medium may be non-permanently secured to said surface upon contact between the outermost exposed sticker's undersurface and said surfaces; and whereby said outermost exposed sticker may be peeled off from said stack when a new outermost exposed sticker with fresh adhesive is desired.

2. An apparatus as defined in claim 1 wherein said plurality of stacked adhesive stickers each include a non-adhesive peel-off cover strip emplaced on their undersurface.

3. An apparatus as defined in claim 1 wherein said audio microchip and audio microchip storage medium are mounted in a housing.

4. An apparatus as defined in claim 3 wherein said housing further includes a side wall situated between said mounted audio microchip and audio microchip storage medium, and said fastening means.

5. An apparatus as defined in claim 1 wherein said apparatus includes a microphone, speaker, power source, and record/playback controls.

6. An apparatus as defined in claim 1 wherein said apparatus further includes mechanical means or indicia, or a blinking light system operatively cooperating with a power source, for visually indicating the presence of waiting audio information.

7. An apparatus as defined in claim 1 wherein said apparatus further includes record/playback controls configured in a pushbutton format.

8. An apparatus as defined in claim 1 wherein said apparatus further includes control means for recording and playing back said audio information, configured as a single sliding switch.

9. An apparatus as defined in claim 1 wherein said audio information consists of any of recorded voice messages; salutations; music; advertising or promotional messages; holiday, birthday or special occasion greetings; campaign messages; thank-you messages; or warning, caution or special handling messages—for message conveyance, audio mail, product promotion or self-reminder purposes.

10. An apparatus as defined in claim 1 wherein said surfaces to which the audio microchip and audio microchip storage medium may be fastened are walls, doors, tables, desks, countertops, cabinets, bulletin boards, mirrors, refrigerators, clock-radios or other appliances, within households or office environments; or date-books, notebooks, briefcases, lunchboxes, or other personal carryable objects, so as to temporarily equip the same with audio information within the expected sightline of the intended message recipient.

11. An apparatus as defined in claim 1 wherein said audio information is preserved in said storage medium for repeat playback by said audio microchip until said audio information is "recorded over" by new audio information.

12. An apparatus as defined in claim 1 wherein said apparatus is one of a plurality of apparatuses bearing identical audio information which audio information has been simultaneously programmed or recorded.

13. An apparatus as defined in claim 1 wherein said storage medium durational capacity may be filled with audio information in segments, whereby the user may record and store multiple separate recorded messages of a fixed duration, or of random length, up to the durational capacity of said storage medium, and separately retrieve or "record over" said messages.

14. An apparatus as defined in claim 1 wherein said surfaces to which the audio microchip and audio microchip storage medium may be fastened are any envelope, mailer, box, crate or other form of mailing vessel, package or shipping containers, or the items contained therein, so as to temporarily equip the same with audio information.

15. An apparatus as defined in claim 1 wherein said plurality of stacked adhesive stickers each include the inscription AUDIO MESSAGE ENCLOSED or similar words on their oversurface.

16. An apparatus as defined in claim 1 wherein said apparatus further includes a free-standing article independent of and engageable with said audio microchip and audio microchip storage medium; which free-standing article has integral thereto said plurality of stacked adhesive stickers; whereby the audio microchip and audio microchip storage medium may be non-permanently secured to said surface by fastening said free-standing article to said surface and then removably engaging said audio microchip and audio microchip storage medium with said free-standing article.

17. An apparatus as defined in claim 16 wherein said free-standing article includes an independent plate having integral thereto said plurality of stacked adhesive stickers; whereby the audio microchip and audio microchip storage medium may be non-permanently secured to said surface by fastening said independent plate to said surface and then removably engaging said audio microchip and audio microchip storage medium with said independent plate.

18. An apparatus for bearing and temporarily positioning audio information, comprising:

(a) an audio microchip for recording and reproducing said audio information mounted in a housing;

(b) an audio microchip storage medium for storing said audio information mounted in said housing;

(c) control means for recording and playing back said audio information, configured as a single sliding switch;

(d) a clip-on covering sheath disposable over said sliding switch, safeguarding said switch during transit of the apparatus; and (e) fastening means for non-permanently securing said audio microchip and storage medium to any surface.

19. An apparatus as defined in claim 18 wherein said housing further includes a side wall situated between said mounted audio microchip and audio microchip storage medium, and said fastening means.

20. An apparatus an defined in claim 18 wherein said housing includes side walls and joining walls; wherein said control means are positioned along one of said joining walls of the apparatus; wherein said side walls further have an indented area adjacent said sliding switch record/playback controls; and wherein said clip-on covering sheath is correspondingly dimensioned with said indented area and engageable therewith.

21. An apparatus as defined in claim 18 wherein said apparatus further includes a microphone, speaker and power source.

22. An apparatus as defined in claim 18 wherein said apparatus further includes mechanical means or indicia, or a blinking light system operatively cooperating with a power source for visually indicating the presence of waiting audio information.

23. An apparatus as defined in claim 18 wherein said audio information consists of any of recorded voice messages; salutations; music; advertising or promotional messages; holiday, birthday or special occasion greetings; campaign messages; thank-you messages; or warning, caution or special handling messages—for message conveyance, audio mail, product promotion or self-reminder purposes.

24. An apparatus as defined in claim 18 wherein said surfaces to which the audio microchip and audio microchip storage medium may be fastened are walls, doors, tables, desks, countertops, cabinets, bulletin boards, mirrors, refrigerators, clock-radios or other appliances, within households or office environments; or date-books, notebooks, briefcases, lunchboxes, or other personal carryable objects, so as to temporarily equip the same with audio information within the expected sightline of the intended message recipient.

25. An apparatus as defined in claim 18 wherein said audio information is preserved in said storage medium for repeat playback by said audio microchip until said audio information is "recorded over" by new audio information.

26. An apparatus as defined in claim 18 wherein said apparatus is one of a plurality of apparatuses bearing identical audio information which audio information has been simultaneously programmed or recorded.

27. An apparatus as defined in claim 18 wherein said storage medium durational capacity may be filled with audio information in segments, whereby the user may record and store multiple separate recorded messages of a fixed duration, or of random length, up to the durational capacity of said storage medium, and separately retrieve or "record over" said messages.

28. An apparatus as defined in claim 18 wherein said surfaces to which the housed audio microchip and audio microchip storage medium may be fastened are any envelope, mailer, box, crate or other form of mailing vessel, package or shipping containers, or the items contained therein, so as to temporarily equip the same with audio information.

29. An apparatus as defined in claim 18 wherein said fastening means for non-permanently securing said housed audio microchip and storage medium to any surface comprises one or more magnets; one or more suction cups; or hook and loop material.

30. An apparatus as defined in claim 18 wherein said fastening means for non-permanently securing said housed audio microchip and storage medium to any surface includes one or more adhesive stickers.

31. An apparatus as defined in claim 30 wherein said adhesive sticker or stickers each include a non-adhesive peel-off cover strip emplaced on its undersurface.

32. An apparatus as defined in claim 18 wherein said apparatus further includes a nesting area for said housed audio microchip and audio microchip storage medium, formed with means which include a free-standing article independent of and engageable with said housed audio microchip and audio microchip storage medium; which free-standing article has integral thereto said fastening means; where by the housed audio microchip and audio microchip storage medium may be non-permanently secured to said surface by fastening said free-standing article to said surface and then snugly, removably nesting said housed audio microchip and audio microchip storage medium in said nesting area.

33. An apparatus as defined in claim 32 wherein said nesting area comprises a space formed by securing said free-standing article against an opposing surface.

34. An apparatus as defined in claim 18 wherein said apparatus further includes a free-standing article independent of and engageable with said housed audio microchip and audio microchip storage medium; which free-standing article has integral thereto said fastening means; whereby the housed audio microchip and audio microchip storage medium may be non-permanently secured to said surface by fastening said free-standing article to said surface and then removably engaging said housed audio microchip and audio microchip storage medium with said free-standing article.

35. An apparatus as defined in claim 34 wherein said free-standing article comprises an independent plate having integral thereto said fastening means; whereby the housed audio microchip and audio microchip storage medium may be non-permanently secured to said surface by fastening said independent plate to said surface and then removably engaging said housed audio microchip and audio microchip storage medium with said independent plate.

36. An apparatus for bearing and temporarily positioning audio information, comprising:

(a) a housing conjoinable to an independent plate;

(b) an independent plate conjoinable with said housing;

(c) an audio microchip for recording and reproducing said audio information mounted in said housing;

(d) an audio microchip storage medium for storing said audio information mounted in said housing;

(e) mechanical means or indicia, or a blinking light system operatively cooperating with a power source, for visually indicating the presence of waiting audio information; and (f) said independent plate having integral thereto a fastening means for securing said independent plate to any surface; whereby the housed audio microchip and audio microchip storage medium may be non-permanently secured to said surface by fastening said independent plate to said surface and then removably conjoining said housed audio microchip and audio microchip storage medium to said independent plate.

37. An apparatus as defined in claim 36 wherein said independent plate has a protruding tongue area, and said housing has an indented grooved area of corresponding size and dimension to said protruding tongue area of said plate, said grooved area extending from the bottom of said housing to a stopper area, whereby said housing may be slidably engaged to said plate.

38. An apparatus as defined in claim 36 wherein said apparatus includes a microphone, speaker, power source, and record/playback controls.

39. An apparatus as defined in claim 36 wherein said apparatus further includes record/playback controls configured in a pushbutton format.

40. An apparatus as defined in claim 36 wherein said apparatus further includes control means for recording and playing back said audio information, configured as a single sliding switch.

41. An apparatus as defined in claim 36 wherein said fastening means integral with said independent plate comprises any of one or more magnets; one or more suction cups; or hook and loop material.

42. An apparatus as defined in claim 36 wherein said fastening means integral with said independent plate comprises one or more adhesive stickers.

43. An apparatus as defined in claim 36 wherein said adhesive sticker or stickers each include a non-adhesive peel-off cover strip emplaced on its undersurface.

44. An apparatus as defined in claim 36 wherein said audio information consists of any of recorded voice messages; salutations; music; advertising or promotional messages; holiday, birthday or special occasion greetings; campaign messages; thank-you messages; or warning, caution or special handling messages—for message conveyance, audio mail, product promotion or self-reminder purposes.

45. An apparatus as defined in claim 36 wherein said surfaces to which the independent plate may be fastened and the housed audio microchip and audio microchip storage medium removably conjoined are walls, doors, tables, desks, counter-tops, cabinets, bulletin boards, mirrors, refrigerators, clock-radios or other appliances, within households or office environments; or date-books, notebooks, briefcases, lunchboxes, or other personal carryable objects, so as to temporarily equip the same with audio information within the expected sightline of the intended message recipient.

46. An apparatus as defined in claim 36 wherein said surfaces to which the independent plate may be fastened and the housed audio microchip and audio microchip storage medium removably conjoined are any envelope, mailer, box, crate or other form of mailing vessel, package or shipping containers, or the items contained therein, so as to temporarily equip the same with audio information.

47. An apparatus as defined in claim 36 wherein said audio information is preserved in said storage medium for repeat playback by said audio microchip until said audio information is "recorded over" by new audio information.

48. An apparatus as defined in claim 36 wherein said apparatus is one of a plurality of apparatuses bearing identical audio information which audio information has been simultaneously programmed or recorded.

49. An apparatus as defined in claim 36 wherein said storage medium durational capacity may be filled with audio information in segments, whereby the user may record and store multiple separate recorded messages of a fixed duration, or of random length, up to the durational capacity of said storage medium, and separately retrieve or "record over" said messages.

50. An apparatus for bearing and temporarily positioning audio information, comprising:

(a) an audio microchip for recording and reproducing said audio information mounted in a housing;

(b) an audio microchip storage medium for storing said audio information mounted in said housing; and (c) a free-standing article independent of and engageable with said audio microchip and audio microchip storage medium comprising an independent protective jacket made of styrofoam or other shock absorbent material having carved therefrom a concave area of corresponding size and dimension as said housing, said protective jacket having on its undersurface an adhesive substance or hook and loop material, permitting it to be fastened to any surface; whereby the housed audio microchip and audio microchip storage medium may be non-permanently secured to said surface by fastening said independent protective jacket to said surface and then snugly, removably nesting said housed audio microchip and audio microchip storage medium in said protective jacket.

51. An apparatus as defined in claim 50 wherein said surfaces to which the protective jacket may be fastened and said housed audio microchip and audio microchip storage medium nested are any envelope, mailer, box, crate or other form of mailing vessel, package or shipping containers, or the items contained therein, so as to temporarily equip the same with audio information.

52. An apparatus as defined in claim 51 wherein said adhesive substance permitting said protective jacket to be fastened to any mailing vassal, package, or container surface comprises a firmly securing adhesive substance.

53. An apparatus as defined in claim 50 wherein said apparatus includes a microphone, speaker, power source, and record/playback controls.

54. An apparatus an defined in claim 50 wherein said apparatus further includes control means for recording and playing back said audio information, configured as a single sliding switch.

55. An apparatus as defined in claim 50 wherein said apparatus further includes mechanical means or indicia, or a blinking light system operatively cooperating with a power source, for visually indicating the presence of waiting audio information.

56. An apparatus as defined in claim 50 wherein said audio information consists of any of recorded voice messages; salutations; music; advertising or promotional messages; holiday, birthday or special occasion greetings; campaign messages; thank-you messages; or warning, caution or special handling messages—for message conveyance, audio mail, product promotion or self-reminder purposes.

57. An apparatus as defined in claim 50 wherein said audio information is preserved in said storage medium for repeat playback by said audio microchip until said audio information is "recorded over" by new audio information.

58. An apparatus as defined in claim 50 wherein said apparatus is one of a plurality of apparatuses bearing identical audio information which audio information has been simultaneously programmed or recorded.

59. An apparatus as defined in claim 50 wherein said storage medium durational capacity may be filled with audio information in segments, whereby the user may record and store multiple separate recorded messages of a fixed duration, or of random length, up to the durational capacity of said storage medium, and separately retrieve or "record over" said messages.

60. An apparatus for bearing and temporarily positioning audio information, comprising:

(a) an audio microchip for recording and reproducing said audio information mounted in a housing;

(b) an audio microchip storage medium for storing said audio information mounted in said housing; and (c) a free-standing article independent of and engageable with said housed audio microchip and audio microchip storage medium comprising an independent foldable holder with a "pop-up" nesting area of closely corresponding size and dimension to said housing, said foldable holder having on its undersurface an adhesive substance, permitting it to be fastened to any surface; said holder being formed in a foldable configuration to include a center leaf, end leaves and joining leaves, said center leaf having integral therewith a foldable support strip perpendicular thereto; whereby the housed audio microchip and audio microchip storage medium may be non-permanently secured to said surface by adhesively fastening said independent foldable holder to said surface and then snugly, removably nesting said housed audio microchip and audio microchip storage medium in said foldable holder's "pop-up" nesting area.

61. An apparatus as defined in claim 60 wherein said foldable holder's end leaves and support strip have on their undersurface said adhesive substance, permitting said foldable holder to be fastened to any surfacer whereby the housed audio microchip and audio microchip storage medium may be non-permanently secured to said surface by adhesively fastening said independent foldable holder to said surface via said end leaves and support strip, and then snugly, removably nesting said housed audio microchip and audio microchip storage medium in said "pop-up" nesting area boundaried by said center leaf, the extended joining leaves, the support strip and the surface to which the end leaves and support strip are fastened.

62. An apparatus as defined in claim 60 wherein said support strip perpendicular to said center leaf is integral therewith along part or all of the lower edge of said center leaf.

63. An apparatus as defined in claim 60 wherein said surfaces to which the foldable holder may be fastened and said housed audio microchip and audio microchip storage medium nested are any envelope, mailer, box, crate or other form of mailing vessel, package or shipping containers, or the items contained therein, so as to temporarily equip the same with audio information.

64. An apparatus as defined in claim 63 wherein said adhesive substance permitting said foldable holder to be fastened to any mailing vessel, package, or container surface comprises a firmly securing adhesive substance.

65. An apparatus as defined in claim 60 wherein said apparatus includes a microphone, speaker, power source, and record/playback controls.

66. An apparatus as defined in claim 60 wherein said apparatus further includes control means for recording and playing beck said audio information, configured as a single sliding switch.

67. An apparatus as defined in claim 60 wherein said apparatus further includes mechanical means or indicia, or a blinking light system operatively cooperating with a power source, for visually indicating the presence of waiting audio information.

68. An apparatus as defined in claim 60 wherein said audio information consists of any of recorded voice messages; salutations; music; advertising or promotional messages; holiday, birthday or special occasion greetings; campaign messages; thank-you messages; or warning, caution or special handling messages—for message conveyance, audio mail, product promotion or self-reminder purposes.

69. An apparatus as defined in claim 60 wherein said audio information is preserved in said storage medium for repeat playback by said audio microchip until said audio information is "recorded over" by new audio information.

70. An apparatus as defined in claim 60 wherein said apparatus is one of a plurality of apparatuses bearing identical audio information which audio information has been simultaneously programmed or recorded.

71. An apparatus as defined in claim 60 wherein said storage medium durational capacity may be filled with audio information in segments, whereby the user may record and store multiple separate recorded messages of a fixed duration, or of random length, up to the durational capacity of said storage medium, and separately retrieve or "record over" said messages.

* * * * *